United States Patent [19]

Borgstrom et al.

[11] Patent Number: 4,762,501

[45] Date of Patent: Aug. 9, 1988

[54] EXTENDED CONTACT

[75] Inventors: Alan D. Borgstrom, Hackettstown; Larry N. Siebens, Whippany, both of N.J.

[73] Assignee: Amerace Corporation, Hackettstown, N.J.

[21] Appl. No.: 904,913

[22] Filed: Sep. 8, 1986

[51] Int. Cl.[4] ..... H01R 13/648

[52] U.S. Cl. ..... 439/131; 439/607; 439/521

[58] Field of Search ..... 339/34, 116 R, 116 C, 339/205, 111, 204, 143 R; 174/73 R, 84 R, 84 C; 439/607-610, 131, 521-523

[56] References Cited

U.S. PATENT DOCUMENTS

| | | | |
|---|---|---|---|
| 3,009,986 | 11/1961 | Stephens | 174/84 C |
| 3,019,284 | 1/1962 | Matthysse | 174/84 C |
| 3,350,677 | 10/1967 | Daum | 174/72 R |
| 3,960,433 | 6/1976 | Boliver | 339/111 |
| 4,006,288 | 2/1977 | Stevens | 174/73 R |
| 4,222,625 | 9/1980 | Reed | 339/111 |
| 4,234,757 | 11/1980 | Simons | 174/73 R |
| 4,354,721 | 10/1982 | Luzzi | 339/111 |

*Primary Examiner*—J. Patrick McQuade
*Attorney, Agent, or Firm*—David Teschner

[57] ABSTRACT

This invention is directed to electrical connectors for joining components of high voltage electrical systems, such as splices and elbows for joining high voltage cables and high voltage cables to transformers and the like. Each connector has at least one extendable conductor to which a high voltage cable may be coupled outside of the housing and then returned to the protection of the housing. Typically the elbow has one while the splice has two extendable conductors. Removable fasteners may be used to hold the extendable conductors out of or adjacent the housing ends and lockable fasteners hold the completed joints within the housing.

28 Claims, 6 Drawing Sheets

EXTENDED CONTACT

BACKGROUND OF THE INVENTION

1. Field of the Invention:

The invention is directed to electrical connectors for joining together various components of a high voltage system, such as transformers and high voltage cables and more particularly to splices for joining high voltage cables and elbows for joining high voltage cables to transformers or the like.

2. Description of the Prior Art:

Some of the better known prior art is illustrated in FIGS. 1 to 5 of this Application taken from prior patents of the assignee of the instant Application. FIGS. 1 and 2 are taken from FIG. 1 of U.S. Pat. No. 4,006,288 issued Feb. 1, 1977. These figures show the use of a single housing 20 to be installed over metallic splice 22 once it has been crimped to the ends of high voltage cables 24 and 26. However, in order to use housing 20, a goodly portion of the outer jacket and perhaps the shield have to be removed from cables 24 and 26 so that housing 20 can be placed on cable 24 (see FIG. 1) initially and then moved to its final position over splice 22 as shown in FIG. 2. The removed shield and jacket must be replaced using suitable materials. This arrangement has the principal advantage that the installer knows that the joint between the conductors of the cables is solid and sound. This principal disadvantage is that the removal of the cable jacket and shield disrupts the integrity of the cable and the taped jacket and shield may not provide adequate protection over a long time span.

A second prior art approach for splices is shown in FIGS. 3 and 4 taken from FIGS. 6 and 7 of U.S. Pat. No. 3,350,677 issued Sept. 26, 1967. These drawings illustrate the so-called pin and socket approach. To the bared conductor 28 of high voltage cable 24 is crimped a pin connector 30 made up of a crimp barrel 32 to receive bared conductor 28 and a pin 34. The entire connector 30 and the end of cable 24 are surrounded by an insulating cover 36 which has a recess 38 to provide access to pin 34. To the bared conductor 40 of high voltage cable 26 (see FIG. 3) is crimped a socket connector 42 made up of a crimp barrel 44 to receive bared conductor 40 and a socket 46 having a recess 48. The entire connector 42 and the end of cable 26 are surrounded by an insulating cover 50 having a reduced outer diameter portion 52 receivable within the recess 28 of cover 36. When assembled, as shown in FIG. 4, pin 34 enters the recess 48 of socket 46 for electrical continuity and reduced outer diameter portion 52 of cover 50 enters recess 38 of cover 36 for insulation integrity. This arrangement has the principal advantage that the insulation integrity is not reduced but this arrangement has the principal disadvantage that the installer cannot be sure he has properly mated the pin 34 and socket 46.

FIG. 5 shows an elbow according to the prior art and is taken from FIG. 4 of U.S. Pat. No. 4,234,757 issued Nov. 18, 1980. Elbow 60 has a unitary L-shaped housing 62 consisting of a vertical section 64 and a horizontal section 66 with passages 68 and 70, respectively in such sections. Passages 68 and 70 communicate with one another in the region of the jointure of said vertical and horizontal sections 64 and 66, respectively. A high voltage cable 72 has its bared conductor (not shown) crimped to the crimpable section 76 of coupler 78. This is done outside of the housing 62 so that the crimp can be inspected. Once complete, cable 72, with coupler 78 attached, is placed in passage 68. The male probe 74 is now introduced through passage 70 in horizontal section 66. Probe 74 is threaded at one end so as to engage the internally threaded section 80 of coupler 78 thus effectively joining high voltage cable 72 to probe 74. The advantage of this arrangement is that the crimp between the conductor of the high voltage cable 72 and coupler 78 can be done outside of housing 62 where it can be inspected. The disadvantage of this arrangement is that probe 74 is assembled to coupler 78 inside housing 62 in a completely blind manner. It is not known if the screw threads of probe 74 and coupler 78 engaged at all, (no electrical path) engaged partially, or cross-threaded giving a high impedance contact and possibly causing the joint to burn or do something else. Also, the reduction in metal of the coupler 78 to make the threaded aperture weakens the joint. This joint is subjected to great stress each time the elbow 60 is installed or removed from a transfer bushing or the like. This stress may degrade even a good joint.

SUMMARY OF THE INVENTION

The present invention seeks to overcome the shortcomings of the prior art devices by providing electrical connectors for joining the components of a high voltage system which can be coupled to electrical conductors outside of their insulated housing to provide a solid, inspectable joint and thereafter installed into the insulating housing without disturbing the jacket, shield or any other portion of the cable thus assuring the integrity of such cable.

The above set out joint can be achieved by the novel connector disclosed and claimed herein which employs at least one extendable conductor to which a high voltage cable can be coupled after which the extendable conductor and coupling means are inserted and locked into the passage of an insulating housing which receives the cable in its original construction. In a splice, a second extendable conductor and coupling are provided to be installed and inserted into the housing as with the first extendable conductor. On the other hand an elbow used to join a high voltage cable to a transformer or bushing etc. employs a male probe intead of a second extendable conductor.

The combined extendable conductors or extendable conductor and probe can be unitary with an internal conductor and the combined lengths of the conductors employed may be longer or shorter than the elongate tubular insulating housing. Retaining devices may be installed to set the positions of the extendable conductor couplers prior to use and locking devices employed to fix the positions of the assembled extendable conductors, couplings and high voltage cable within the passage of the insulating housing. The locking device may engage itself or a strain relief tubing therein. In the housing passage such conductors may take a coiled or random configuration.

The housing and extendable conductors may be proportioned to take the place of ordinary splices or made much longer to act as a replacement splice to fit the splice to be replaced as well as account for portions of the cable also removed as well that required within the splice.

In the elbow, the extendable conductor may be fastened directly to the male probe or fastened through a bimetallic arrangement wherein an aluminum cable can be coupled to a copper probe. Alternatively, the extendable conductor, internal conductor and probe can be made in one piece to eliminate the need for any internal joint. It is therefore an object of this invention to provide novel electrical connectors to join components of a high voltage system.

It is another object of this invention to permit the connection of high voltage cables to electrical connectors in a solid, inspectable manner.

It is another object of this invention to permit the connection of high voltage cables to electrical connectors in a solid, inspectable manner external of the connector insulating housing.

It is another object of this invention to permit the connection of high voltage cables to electrical connectors without reducing the integrity of the insulation of such cables.

It is still another object of this invention to permit the connection of high voltage cables to electrical connectors in a solid, inspectable manner external of the connector insulating housing and without reducing the integrity of the insulation of such cables.

It is yet another object of this invention to permit the connection of high voltage cables to electrical connectors employing conductors which can be inserted into the housing of such electrical connectors after the coupling of high voltage cables thereto.

It is yet another object of this invention to provide internal stress relief for high voltage cables joined by a splice according to the instant invention.

It is still another object of this invention to provide a splice of increased length as a replacement splice where a splice and adjacent high voltage cables must be replaced.

It is yet another object of this invention to provide an elbow where its probe is coupled to a high voltage cable through a bimetallic joint.

It is another object of this invention to provide an elbow where its probe, joint and extendable conductor are unitary and continuous.

Other objects and features of the invention will be pointed out and shown in the following description and claims and illustrated in the accompanying drawings, which disclose, by way of examples, the principles of the invention, and the best modes which have been contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
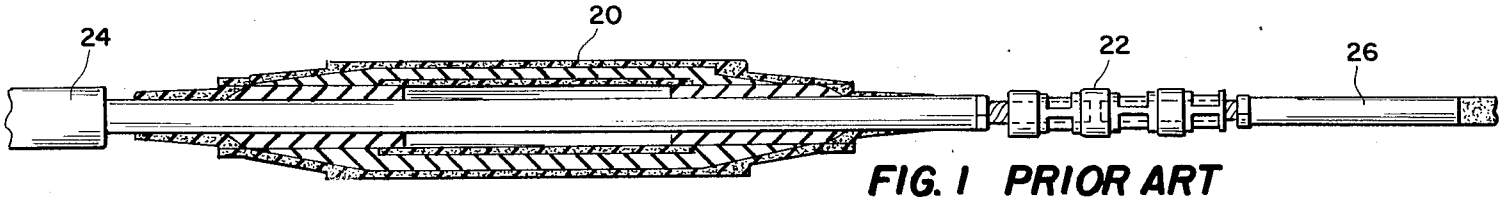
FIG. 1 PRIOR ART
FIGS. 1 and 2 are side elevations, partially in section, of a high voltage cable splice of the prior art in its partially and fully assembled conditions, respectively, and based upon FIG. 1 of U.S. Pat. No. 4,006,288 issued Feb. 1, 1977.

Turning now to FIGS. 6 to 12 there is shown the construction and use of an electrical connector constructed in accordance with the concepts of the instant invention. The particular electrical connector shown in these figures is a splice but the principals and concepts are equally applicable to an elbow. A housing 80 is formed in the usual manner of a layer of insulating elastomeric 82 having a passage 84 therethrough and enlarged in the central portion as at 86. An outer layer 88 of conductive elastomeric brought out to the entrance to the passage to provide a continuous shield from high voltage cable 90 to high voltage cable 92 along the outer surface of housing 80. The passage 84 is similarly provided with a layer 94 of conductive elastomeric which stops short of the ends of housing 80 and terminates in pads to provide an internal shield to hold all internal components at a unform voltage and prevents corona discharge.

Figure 6:
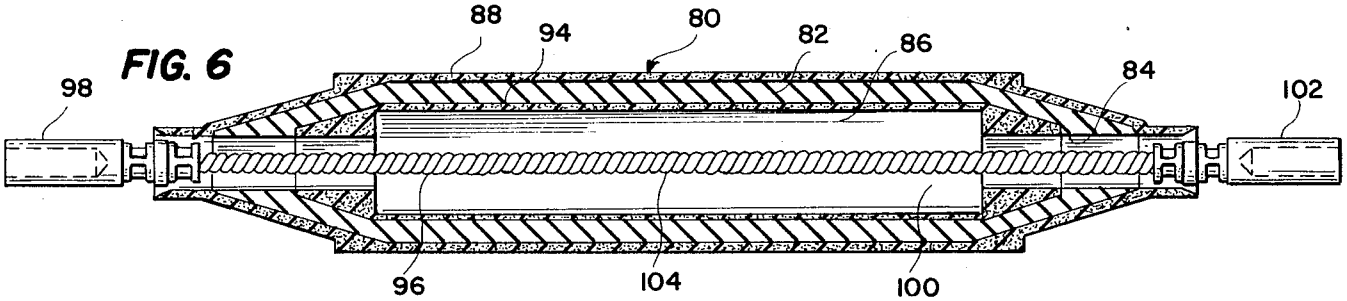
FIG. 6 is a side elevation, partially in section, showing a splice with extendable conductors constructed in accordance with the concepts of the instant invention.
Figure 9:
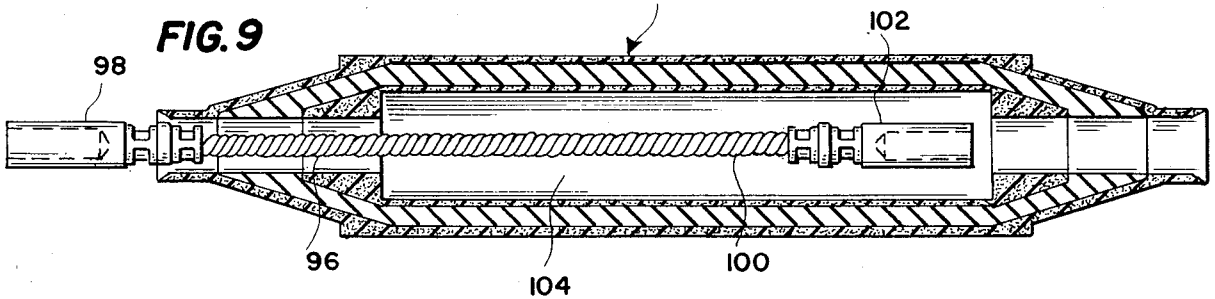
FIG. 9 is a side elevation, partially in section, showing a further embodiment of a splice with extendable conductors constructed in accordance with the concepts of the instant invention.

Positioned within passage 84 are a first extendable conductor 96 having a first crimpable coupling 98 crimped to the free end thereof, a second extendable conductor 100 having a second crimpable coupling 102 crimped to the free end thereof and a conductor 104 to join the ends of said first and second extendable conductors, 96 and 100, respectively. As shown in FIG. 6 the first and second extendable conductors 96 and 100, respectively, as well as the conductor 104 are formed of one continuous length of material and it together with first coupling 98 and second coupling 102 exceed the length of housing 80. Alternatively, an extendable conductor, further conductor and conductor may be separately formed and joined as in the elbow of FIG. 18, to be described below, and also that the combined length of the first extendable conductor 96, the second extendable conductor 100, the conductor 104 and the first coupling 98 and second coupling 102 may be less than the length of the housing 80 as is shown in FIG. 9.

Figure 8:
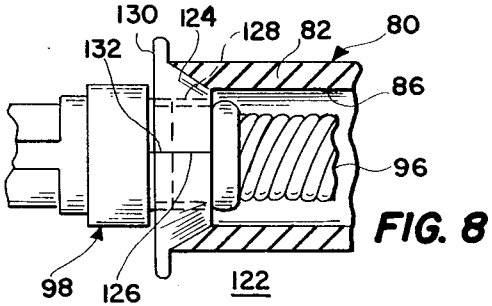
FIG. 8 is a fragmentary, side elevation, partially in section, of another form of retainer used to hold the position of the extendable conductor adjacent the end of the conductor housing and showing it installed on a high voltage cable and engaging the end of a connector housing.
Figure 7:
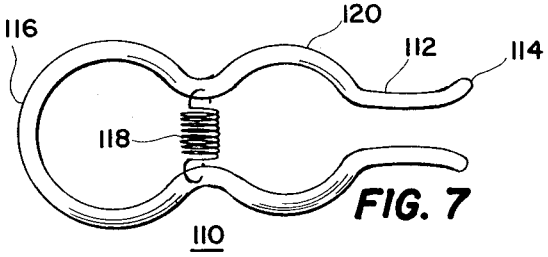
FIG. 7 is a side elevation of one form of retainer used to hold the position of the extendable conductor adjacent the end of the connector housing.
Figure 10:
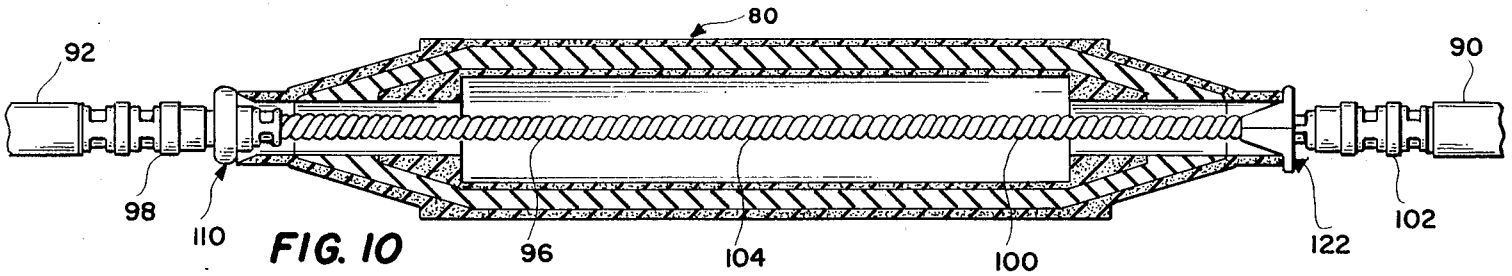
FIG. 10 is the same as FIG. 6 except that it illustrates the connection of two high voltage cables to the splice and the manner of use of the retainers shown in FIGS. 7 and 8.

To fix the first coupling 98 adjacent one end of housing 80 while fixing second coupling 102 adjacent the other end of housing 80 the retainers shown in FIGS. 7 and 8 may be employed as shown in FIG. 10. Retainer 10, as shown in FIG. 7 is made up in a generally C-shape of metal or tough plastic. Two generally parallel legs 112 terminate in outwardly tapered free ends 114 at one end and in a closed arcuate loop 116 at the other. A tension spring 118 joins the legs 112, and arcuate portions 120 are formed between tension spring 118 and free ends 114. The arcuate portions 120 are configured to fit around the couplings 98, 102 and engage the ends of housing 80, as shown to the left in FIG. 10. The tapered lead-ins on free ends 114 make the retainer 110 easy to install, and tension spring 118 permits the retainer to remain in place. Pulling on the loop 116 in a direction opposite to the free ends 114 releases the retainer 110 and permits the couplings 98, 102 to be moved into the passage 86 of housing 80 along with high voltage cables 90, 92.

FIG. 8 shows an alternative retainer 122 which also may be made of metal or tough plastic. Retainer 122 consists of an inwardly tapered collar 124 proportioned to abut the shaft of passage 86 of housing 80 and engage the tapered walls of the passage 86 entrance. Collar 124 is split as at 126 to make removal simple and has an internal passage 128 therethrough which is proportioned to pass the extendable conductor 96 but not the coupling 98, thus preventing the coupling 98 from entering the passage 86 while retainer 122 is in place. A rim 130 is positioned adjacent collar 124 largest diameter and has a diameter which exceeds that of housing 80 to prevent the collar 124 from entering too far into passage 86. Rim 130 is also split as at 132 for easy removal and also has an internal passage of the same size and continuous with collar passage 128. The position of retainer 122 with respect to housing 80 and coupling 102 is shown to the right of FIG. 10. Retainer 122 can be opened along splits 126 and 132 and removed to permit extendable cable 100, coupling 102 and high voltage cable 90 to be moved into passage 84 of housing 80.

In FIG. 10 a splice of the type shown in FIG. 6 is shown with a first high voltage cable 92 crimped to first coupling 98 and held in position at the left end of housing 80 by retainer 110. A second high voltage cable 90 is crimped to second coupling 102 and held in position at the right end of housing 80 by retainer 122. Where the combined lengths of the first and second extendable conductors 98, 100 and conductor 104 are less than the length of housing 80 (see FIG. 9) one of the extendable conductors 96, 100 can be fixed in position or both left without retainers. In such case, for example, one cable 92 is crimped to coupling 98 and extendable conductor 96, coupling 98 and high voltage cable 92 are pushed into passage 84 until coupling 102 is available at the entrance to housing 80. Conductors 96, 100 and 104 are sufficiently strong not to coil or collect in passage enlargement 86 unless it meets resistance at its opposite end.

Figure 11:
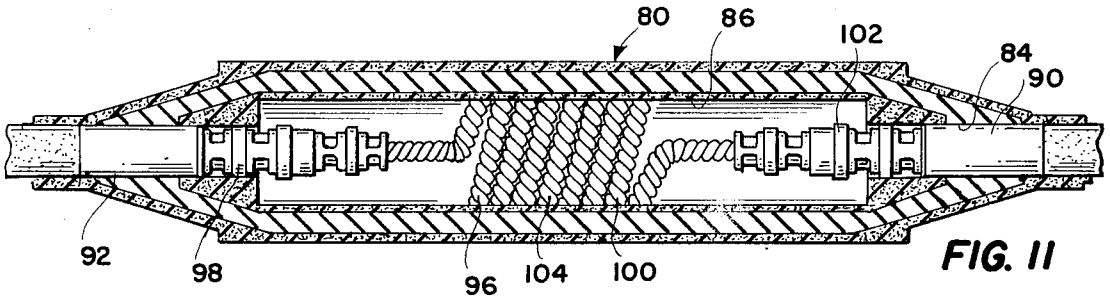
FIG. 11 is a side elevation, partially in section, of the splice of FIG. 10 with the retainers removed and the two extendable conductors in their fully inserted, coil like configuration in the passage of the connector housing.
Figure 12:
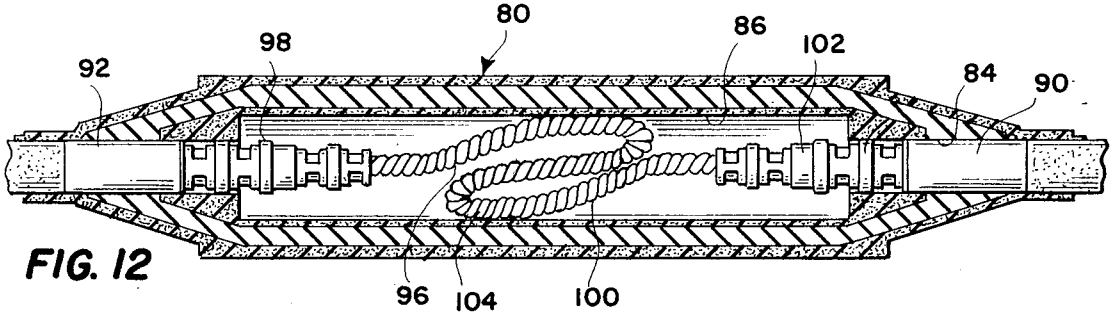
FIG. 12 is similar to FIG. 11 except that the two extendable conductors have taken a random configuration in the passage of the connector housing.

In order to cause the storing of the first and second extendable conductors 96, 100 and conductor 104 in the passage enlargement 86 it is necessary that both couplings 98 and 102, with respective high voltage cables 92 and 90 attached, be forced towards the center of the housing 80. Depending upon the flexibility of conductors 96, 100 and 104 and the freedom of movement of the high voltage cables 90 and 92 the conductors 96, 100 and 104 may be coiled as shown in FIG. 11 or completely random as shown in FIG. 12 or any combination or variation thereof, the exact shape of the conductors 96, 100 and 104 in the passage enlargement 86 is of no consequence.

Figures 13, 14, 15, 16, 17:
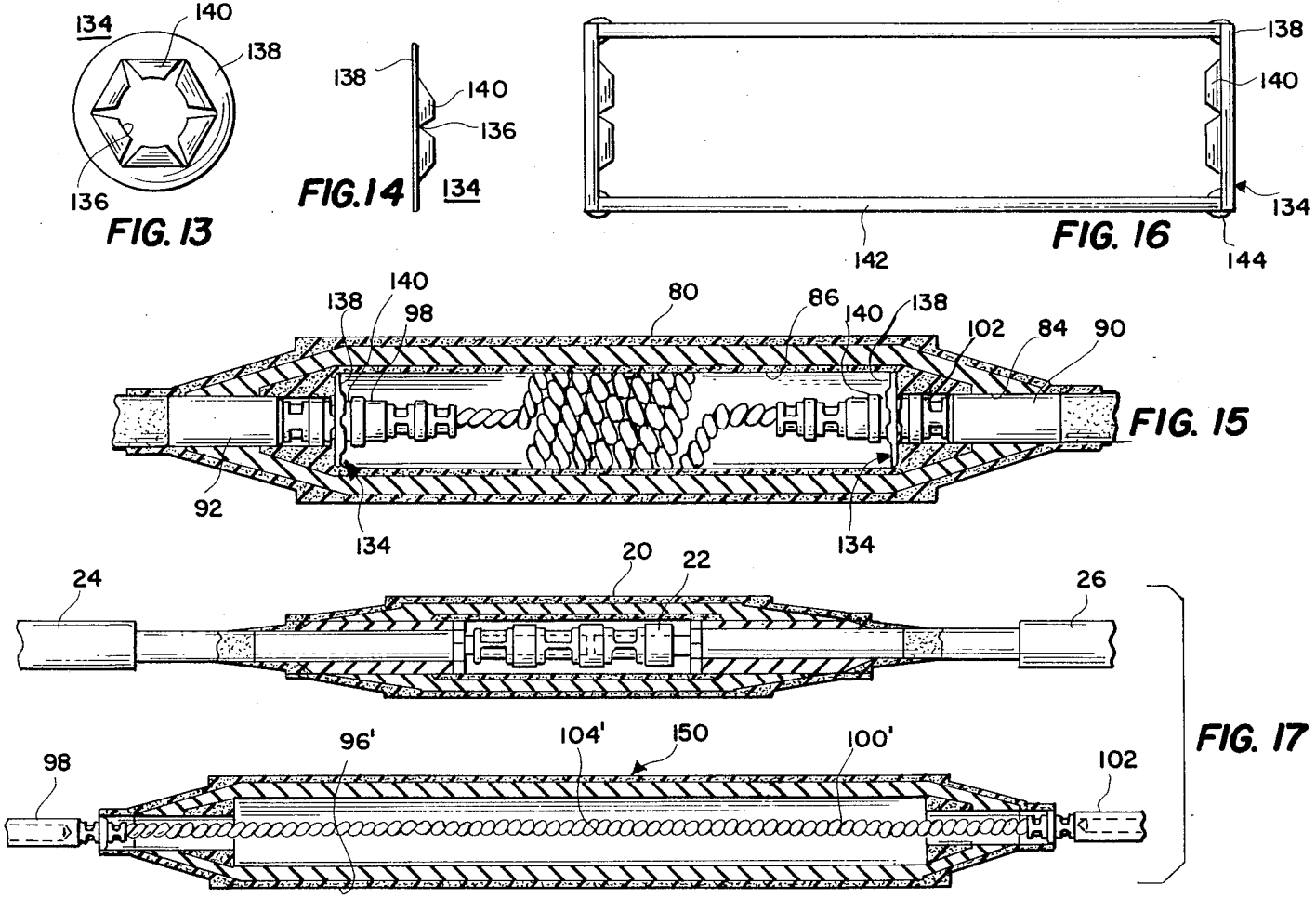
FIG. 13 is a front elevation of a locking retainer employed with the instant invention to prevent withdrawal of the extendable conductors once they have been placed in the housing passage.
FIG. 14 is a side elevation of the locking retainer of FIG. 13.
FIG. 15 is similar to FIG. 11 except that it shows two locking retainers of FIGS. 13 and 14 positioned within the passage of the housing.
FIG. 16 is a side elevation of a strain relief tube with locking retainers of FIGS. 13 and 14 installed to the ends thereof.
FIG. 17 is a side elevation of a standard splice of the type shown in FIG. 2 above, and a replacement splice constructed in accordance with the concepts of the instant invention and illustrating the differences in length between the two.
Figure 19:
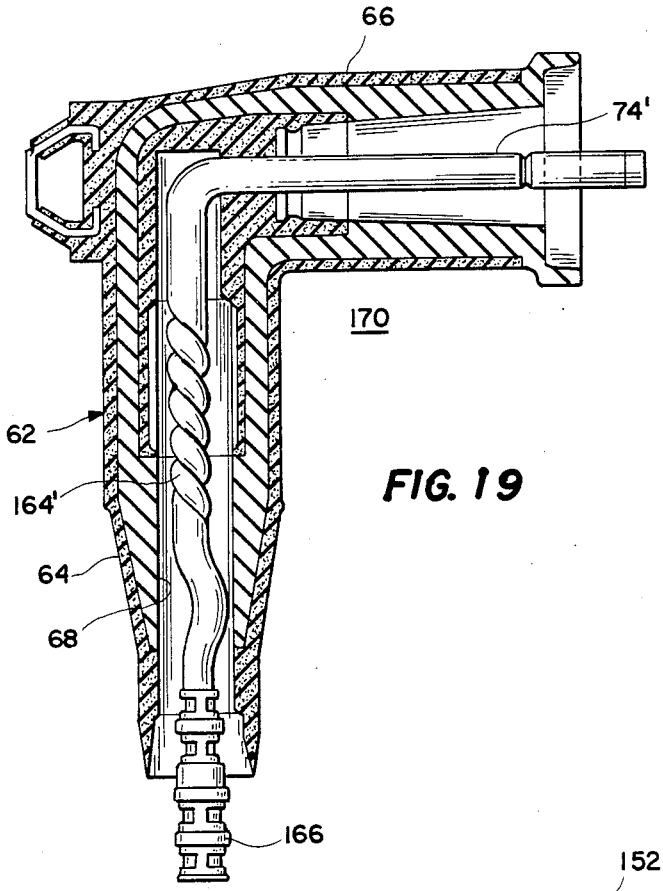
FIG. 19 is a side elevation, partially in section, of another embodiment of an elbow constructed in accordance with the concepts of the instant invention.

Once the conductors 96, 100 and 104 are forced into the passage enlargement 86, means must be provided to prevent the withdrawal of such conductors. This may be accomplished by employing the locking retainer 134 shown in FIGS. 13, 14 and 15. Locking retainer 134 is made of spring stock such as beryllium copper or plastic or the like in the form of a disk and has central aperture 136 extending therethrough. The material adjacent the aperture 136 is segmented and bent out of the plane of the disk (see FIG. 14) to provide a series of one-way locking tabs 140 which permit conductor 96 and coupling 98 to pass therethrough in the direction of the center of housing 80 but which will dig into coupling 98 and prevent its withdrawal when forces are applied in a direction away from the center of housing 80. The unsegmented portion of the disk, in the form of a flat rim 138 which is arranged to engage the vertical shoulder between passage 84 and passage enlargement 86 which prevents removal of the retainer 134 from housing 80. The direct engagement between rim 138 and the shoulder as shown in FIG. 15, when forces are applied to the high voltage cables 90, 92 in directions away from housing 80, applies tensional stresses to housing 80. To minimize these tensional stresses, a strain relief tube 142 as shown in FIG. 16 may be employed. Locking retainers 134 are attached as by welding as at 144 to both ends of a strong, rigid, hollow tube 142 with the locking tabs 140 extending into such tube interior. Any other suitable means may be used to attach retainers 134 to tube 142. The tube 142 with assembly locking retainers 134 can then be placed in the mold and the housing 80 molded about it. Now forces applied to the retainers 134 are applied to the tube 142 rather than directly to housing 80.

Figure 2:
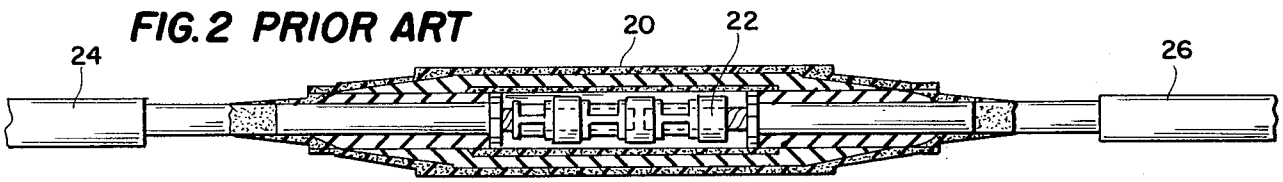
FIG. 2 PRIOR ART
Figure 3:
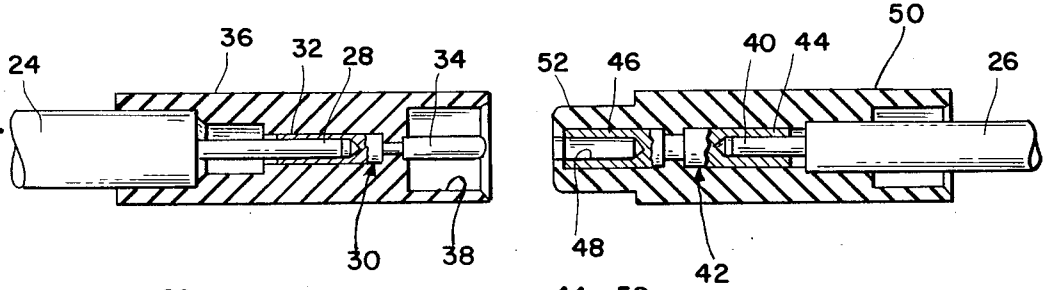
FIG. 3 PRIOR ART
FIGS. 3 and 4, are side elevations, partially in section, of a high voltage cable splice of the prior art in its partially and fully assembled conditions, respectively, and based upon FIGS. 6 and 7, respectively, of U.S. Pat. No. 3,350,677 issued Sept. 26, 1967.
Figure 4:
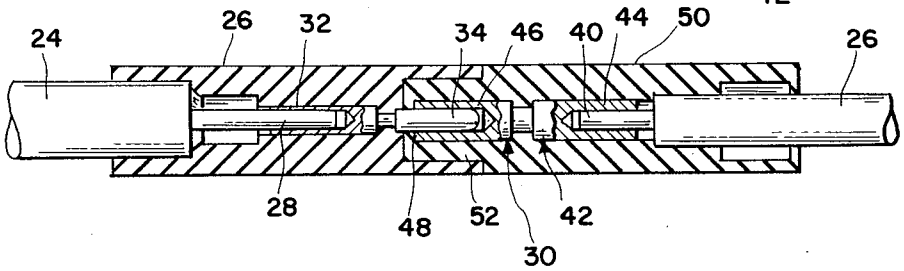
FIG. 4 PRIOR ART

Turning now to FIG. 17 there is shown a standard splice as shown in FIG. 2 and a replacement splice 150 of the type shown in FIG. 6. The replacement splice 150 is far longer than the standard splice and this additional length compensates for not only the splice which has to be removed but also the adjacent portions of the cable as well as provides cable ends to be joined.

Figure 20:
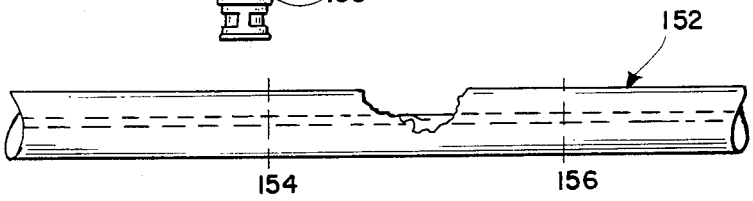
FIG. 20 is a side elevation, partially in section, of a length of high voltage cable showing a cable failure.

When a cable splice fails it usually burns up and burns the portions of the high voltage cable adjacent the splice thus requiring removal of the splice and the damaged cable. Since the cable is of great length and buried, it is not possible to pull more cable into the vault to make a new splice. Instead the usual practice is to cut the cable back and put in two splices with a short length of high voltage cable therebetween. The replacement splice 150 eliminates the need for two splices and the intermediate short length of replacement high voltage cable. The extra length of splice 150 compensates for the splice and adjacent damaged cable and the flexibility of the extendable conductors permits their being coupled to the prepared ends of the original cables without the need to move the buried high voltage cables. Also if a high voltage cable 152 fails it generally burns up at the point of the failure and also affects the adjacent portions of the cable (see FIG. 20). It is necessary to remove the failure and a length of cable 152 to either side to insure the high voltage cable 152 beyond in both directions is sound. Accordingly, a section of high voltage cable from line 154 to line 156 is removed and this section is replaced by a replacement splice 150.

Figure 5:
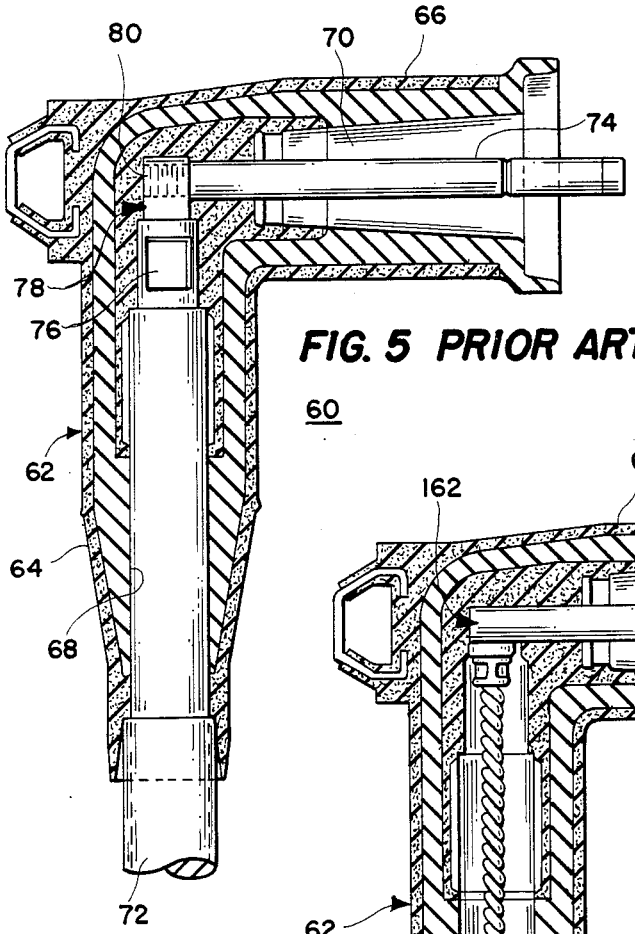
FIG. 5 PRIOR ART
FIG. 5 is a side elevation of a high voltage elbow, partially in section, and based upon FIG. 4 of U.S. Pat. No. 4,234,757 issued Nov. 18, 1980.
Figure 18:
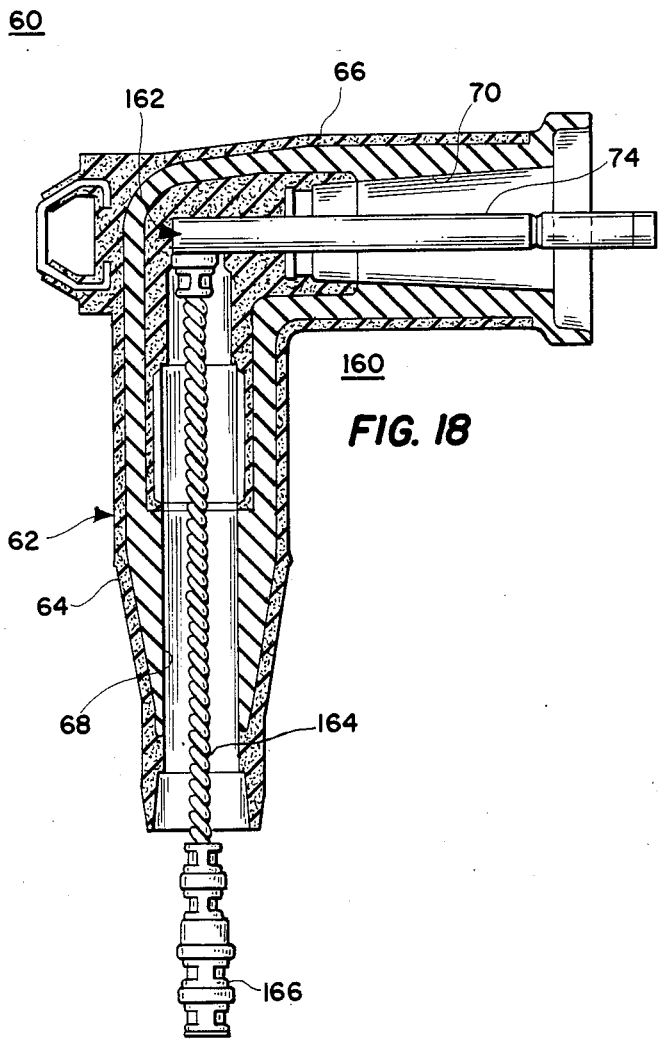
FIG. 18 is a side elevation, partially in section, of an elbow constructed in accordance with the concepts of the instant invention.

Elbow 160 shown in FIG. 18 is fabricated in much the same manner as elbow 60 in FIG. 5 representative of the prior art. Instead of making the joint between male probe 74 and high voltage cable 72 in the housing 62, the joint is made at the fractory before the housing 62 is molded about the male probe 72, the coupling 162 and the extendable conductor 164 with coupling 166 attached. In this way the joint may be inspected and tested before use. The high voltage cable 72 can still be installed outside of the elbow 62 so that the crimp joint with coupling 166 can be inspected before extendable conductor 164 is positioned within passage 68 of vertical section 64 of housing 62.

Coupling 162 may be a solid weld, thus eliminating the problems of non-engagement or partial engagement of the threaded portion of the male probe 74 with threaded portion 80 of coupler 78. It also gives greater flex life to the joint so that installation and removal of elbow 160 a number of times does not destroy coupling 162. Coupling 162 may also be of the bimetallic type where an aluminum extendable conductor 164 may be used with a copper male probe 74.

To eliminate separate parts such as male probe 74, coupling 162 and extendable conductor 164, a single continuous metallic conductor can be formed at one end into male probe 74[1] and at the other into extendable conductor 164[1] with coupling 166 attached thereto. This eliminates the problem of a coupling entirely and assures electrical continuity. Elimination of the joint also provides excellent flex life for the probe-extendable conductor unit.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A device for interconnecting two components of a high voltage system comprising: a housing constructed of an insulating material and having a passage therethrough from a first end of said housing to a second end; at least one extendable conductor means capable of being extended out of said housing through said passage at one of said first and second ends and thereafter capable of being returned to a position in said housing through said passage, said extendable conductor means being reconfigured to return same into said passage of said housing; first coupling means coupled to one end of said one extendable conductor means for coupling said extendable conductor means to a first component of a high voltage system; said first component being at least partially drawn into said passage of said housing as said extendable conductor means is returned and configured in said passage of said housing; conductor means positioned in said passage of said housing having a first end and a second end, said first end of said conductor means being coupled to said other end of said one extendable conductor means, and a further conductor means coupled to said second end of said conductor means to engage a second component of a high voltage system adjacent the passage at the second one of said first and second ends of said housing.

2. A device as defined in claim 1, further comprising: first lock means positioned within said passage of said housing to engage said first coupling means and prevent the withdrawal of said one extendable conductor means from said housing.

3. A device as defined in claim 2, wherein said one extendable conductor means when placed in said housing passage reconfigures to a coiled configuration.

4. A device as defined in claim 2, wherein said one extendable conductor means when placed in said housing passage reconfigures to a random configuration.

5. A device as claimed in claim 1, wherein said further conductor means is a second extendable conductor means capable of being extended out of said housing through said passage at the second of said first and second ends and thereafter capable of being returned to a position in said housing through said passage, said second extendable conductor means being reconfigured to return same into said passage of said housing; second coupling means coupled to one end of said second extendable conductor means for coupling said second extendable conductor means to a second component of a high voltage system said second component being at least partially drawn into said passage of said housing as said second extendable conductor means is returned and reconfigured in said passage of said housing; and said other end of said second extendable conductor means coupled to the second end of said conductor means.

6. A device as defined in claim 5, wherein said one extendable conductor means, said second extendable conductor means and said conductor means are unitary.

7. A device as defined in claim 5, further comprising: first lock means positioned within said passage of said housing to engage said first coupling means and prevent the withdrawal of said one extendable conductor means from said housing; and second lock means positioned within said passage of said housing to engage said second coupling means and prevent the withdrawal of said second extendable conductor means from said housing.

8. A device as defined in claim 5 to replace a high voltage splice connector and predetermined lengths of the adjacent portion of the high voltage cables joined by said splice connector, said housing being fabricated of a length equal to that of said high voltage splice connector and such predetermined cable lengths.

9. A device as defined in claim 1, to replace a high voltage splice connector and predetermined lengths of the adjacent portions of the high voltage cables joined by said splice connector, said housing being fabricated of a length equal to that of said high voltage splice connector and such predetermined cable lengths.

10. A device as defined in claim 1, wherein said one extendable conductor means, said further conductor means and said conductor means are unitary.

11. A device for interconnecting two components of a high voltage system comprising: a housing constructed of an insulating material and having a passage therethrough from a first end of said housing to a second end; at least one extendable conductor means capable of being extended out of said housing through said passage at one of said first and second ends; first coupling means coupled to one end of said one extendable conductor means for coupling said extendable conductor means to a first component of a high voltage system; conductor means positioned in said passage of said housing having a first end and a second end, said first end of said conductor means being coupled to said other end of said one extendable conductor means; a further conductor means coupled to said second end of said conductor means to engage a second component of a high voltage system adjacent the passage at the second one of said first and second ends of said housing; and first removable selectively operable locking means for engaging said one extendable conductor means for positioning and holding said one extendable conductor means outside of said housing, adjacent one of said first and second ends of said housing; said first removable selectively operable locking means, when unlocked and removed permitting said first extendable conductor means to be placed in said passage of said housing adjacent said one of said first and second ends of said housing.

12. A device as defined in claim 11, wherein said first removable, selectively operable locking means comprises a split collar tapered to enter into said housing passage and a split external rim extending perpendicularly to the longitudinal axis of said collar to limit the extent of entrance of said collar into said passage and an internal rim to engage said first coupling means and prevent its entrance into said passage.

13. A device as defined in claim 11, wherein said first removable, selectively operable locking means comprises a generally C-shaped clip having two generally parallel legs joined at a first end and free end portions at the other end; a tension spring coupled between said legs to control the spacing between said legs; said clip being placed between one end of said housing and said first coupling means to prevent entry of said first coupling means into said housing passage.

14. A device for interconnecting two components of a high voltage system comprising: a housing constructed of an insulating material and having a passage therethrough from a first end of said housing to a second end; at least one extendable conductor means capable of being extended out of said housing through said passage at one of said first and second ends; first coupling means coupled to one end of said one extendable conductor means for coupling said extendable conductor means to a first component of a high voltage system; conductor means positioned in said passage of said housing having a first end and a second end, said first end of said conductor means being coupled to said other end of said one extendable conductor means; a further conductor means coupled to said second end of said conductor means to engage a second component of a high voltage system adjacent the passage at the second one of said first and second ends of said housing; further conductor means is a second extendable conductor means capable of being extended out of said housing through said passage at the second of said first and second ends; second coupling means coupled to one end of said second extendable conductor means for coupling said second extendable conductor means to a second component of a high voltage system; and said other end of said second extendable conductor means coupled to the second end of said conductor means; first removable selectively operable locking means for engaging said one extendable conductor means for positioning and holding said one extendable conductor means outside of said housing, adjacent one of said first and second ends of said housing; said first removable selectively operable locking means, when unlocked and removed permitting said first extendable conductor means to be placed in said passage of said housing adjacent said one of said first and second ends of said housing; and a second removable selectively operable locking means for engaging said second extendable conductor means for positioning and holding said second extendable conductor means outside of said housing adjacent the second of said first and second ends of said housing; said second removable selectively operable locking means, when unlocked and removed permitting said second extendable conductor means to be placed in said passage of said housing adjacent said second of said first and second ends of said housing.

15. A device as defined in claim 14, wherein said one extendable conductor means and said second extendable conductor means when placed in said housing passage reconfigures to a generally coiled configuration.

16. A device as defined in claim 14, wherein said one extendable conductor means and said second extendable conductor means when placed in said housing passage reconfigures to a random configuration.

17. A device as defined in claim 14, wherein said first and second removable, selectively operable locking means each comprises a split collar tapered to enter into said housing passage and a split external rim extending perpendicularly to the longitudinal axis of said collar to limit the extent of entrance of said collar into said passage and an internal rim to engage one of said first and second coupling means and prevent its entrance into said passage.

18. A device as defined in claim 14, wherein said first and second removable, selectively operable locking means each comprise a generally C-shaped clip having two generally parallel legs joined at a first end and free end portions at the other end; a tension spring coupled between said legs to control the spacing between said legs; said clip being placed between one end of said housing and one of said first and second coupling means to prevent entry of said first and second coupling means into said housing passage.

19. A device for interconnecting two components of a high voltage system comprising: a housing constructed of an insulating material and having a passage therethrough from a first end of said housing to a second end; at least one extendable conductor means capable of being extended out of said housing through said passage at one of said first and second ends; first coupling means coupled to one end of said one extendable conductor means for coupling said extendable conductor means to a first component of a high voltage system; conductor means positioned in said pasasge of said housing having a first end and a second end, said first end of said conductor means being coupled to said other end of said one extendable conductor means; a further conductor means coupled to said second end of said conductor means to engage a second component of a high voltage system adjacent the passage at the second one of said first and second ends of said housing; and wherein the combined length of said one extendable conductor means, said further conductor means and said conductor means exceeds the length of said housing.

20. A device for interconnecting two components of a high voltage system comprising: a housing constructed of an insulating material and having a passage therethrough from a first end of said housing to a second end; at least one extendable conductor means capable of being extended out of said housing through said passage at one of said first and second ends; first coupling means coupled to one end of said one extendable conductor means for coupling said extendable conductor means to a first component of a high voltage system; conductor means positioned in said passage of said housing having a first end and a second end, said first end of said conductor means being coupled to said other end of said one extendable conductor means; a further conductor means coupled to said second end of said conductor means to engage a second component of a high voltage system adjacent the passage at the second one of said first and second ends of said housing; further conductor means is a second extendable conductor means capable of being extended out of said housing through said passage at the second of said first and second ends; second coupling means coupled to one end of said second extendable conductor means for coupling said second extendable conductor means to a second component of a high voltage system; and said other end of said second extendable conductor means coupled to the second end of said conductor means; and wherein the combined length of said one extendable conductor means, said conductor means and said second extendable conductor means exceeds the length of said housing.

21. A device for interconnecting two components of a high voltage system comprising: a housing constructed of an insulating material and having a passage therethrough from a first end of said housing to a second end; at least one extendable conductor means capable of being extended out of said housing through said passage at one of said first and second ends; first coupling means coupled to one end of said one extendable conductor means for coupling said extendable conductor means to a first component of a high voltage system; conductor means positioned in said passage of said housing having a first end and a second end, said first end of said conductor means being coupled to said other end of said one extendable conductor means; a further conductor means coupled to said second end of said conductor means to engage a second component of a high voltage system adjacent the passage at the second one of said first and second ends of said housing; and first lock means positioned within said passage of said housing to engage said first coupling means and prevent the withdrawal of said one extendable conductor means from said housing; said first lock means comprises a flat disk fabricated from spring stock material having a central aperture therethrough and a series of one-way locking tabs adjacent said aperture to engage said first coupling means to prevent withdrawal of said one extendable conductor means from said housing passage.

22. A device as defined in claim 21, further comprising a strain relief tube mounted within said passage of said housing; and said first lock means is connected to one end of said tube so that any forces applied to said one extendable conductor means are transferred to said tube and not directly to said housing.

23. A device for interconnecting two components of a high voltage comprising:

a housing constructed of an insulating material and having a passage therethrough from a first end of said housing to a second end;

at least one extendable conductor means capable of being extended out of said housing through said passage at one of said first and second ends and thereafter capable of being returned to a position in said housing through said passage, said one extendable conductor means being reconfigured to return same into said passage of said housing;

first coupling means coupled to one end of said one extendable conductor means for coupling said one extendable conductor means to a first component of a high voltage system; said first component being at least partially drawn into said passage of said housing as said one extendable conductor means is returned and reconfigured in said passage of said housing; conductor means positioned in said passage of said housing having a first end and a second end, said first end of said conductor means being coupled to said other end of said one extendable conductor means;

a second extendable conductor means capable of being extended out of said housing through said passage at the second of said first and second ends and thereafter capable of being returned to a position in said housing through said passage, said second extendable conductor means being reconfigured to return same into said passage of said housing, said second extendable conductor means coupled to said second end of said conductor means to engage a second component of a high voltage system adjacent the passage at the second one of said first and second ends of said housing;

second coupling means coupled to one end of said second extendable conductor means for coupling said second extendable conductor means to a second component of a high voltage system; and said other end of said second extendable conductor means coupled to the second end of said conductor means;

first lock means positioned within said passage of said housing adjacent one of said first and second ends to engage said first coupling means after said first coupling means is returned into said housing passage when said first extendable conductor means is reconfigured and prevent the withdrawal of said one extendable conductor means from said housing thereafter;

second lock means positioned within said passage of said housing adjacent said second of said first and second ends to engage said second coupling means after said second coupling means is returned into said housing passage when said second extendable conductor means is reconfigured and prevent the withdrawal of said second extendable conductor means from said housing thereafter; said first and second lock means each comprise flat disks fabricated from spring stock material having a central aperture therethrough and a series of one-way locking tabs adjacent said aperture to engage, respectively, said first and second coupling means.

24. A device as defined in claim 23, further comprising a strain relief tube mounted within said passage of said housing; and said first lock means is connected to a first end of said tube and said second lock means is connected to a second end of said tube so that any forces applied to said one and said second extendable conductor means are applied to said tube and not directly to said housing.

25. A device for interconnecting two components of a high voltage system comprising: a housing constructed of an insulating material and having a passage therethrough from a first end of said housing to a second end; at least one extendable conductor means capable of being extended out of said housing through said passage at one of said first and second ends; first coupling means coupled to one end of said one extendable conductor means for coupling said extendable conductor means to a first embodiment of a high voltage system; conductor means positioned in said passage of said housing having a first end and a second end, said first end of said conductor means being coupled to said other end of said one extendable conductor means; a further conductor means coupled to said second end of said conductor means to engage a second component of a high voltage system adjacent the passage at the second one of said first and second ends of said housing; said housing is formed in a generally L-shape configuration providing a horizontal portion and a vertical portion; said one extendable conductor means extending within that portion of the passage in the vertical portion, said further conductor means extending within that portion of the passage in the horizontal portion and said conductor means is positioned at the intersection of the passages in said horizontal and vertical portions.

26. A device as defined in claim 25, wherein said conductor means is a coupler to join said one extendable conductor means with said further conductor means.

27. A device as defined in claim 25 wherein said conductor means is a bimetallic coupler to join said one extendable conductor means with said further conductor means when both are fabricated of different materials.

28. A device as defined in claims 25, wherein said one extendable conductor means, said conductor means and said further conductor means are fabricated from one continuous strip of material.

* * * * *

UNITED STATES PATENT AND TRADEMARK OFFICE

CERTIFICATE OF CORRECTION

PATENT NO. : 4,762,501

DATED : August 9, 1988

INVENTOR(S) : Borgstrom et al.

It is certified that error appears in the above—identified patent and that said Letters Patent is hereby corrected as shown below:

In the Specification:

line 50, change the numeral "28" to --38--.

Col. 2, line 58, after the word "engage" insert --the housing--.

Col. 5, line 2, change "unform" to --uniform--.

line 27, change the numeral "10" to --110--.

line 46, change "shaft" to --start--.

Col. 6, line 4, change the numeral "98" to --96--.

Col. 7, line 28, change "fractory" to --factory--.

UNITED STATES PATENT AND TRADEMARK OFFICE

CERTIFICATE OF CORRECTION

PATENT NO. : 4,762,501

DATED : August 9, 1988

INVENTOR(S) : Borgstrom et al.

It is certified that error appears in the above—identified patent and that said Letters Patent is hereby corrected as shown below:

In the Claims:

Col. 8, line 13, change "configured" to --reconfigured--.

Col. 11, line 2, change "pasasge" to --passage--.

Col. 12, line 11, after the word "voltage" insert --system--.

Col. 13, line 23, change "embodiment" to --component--.

Signed and Sealed this

Tenth Day of July, 1990

*Attest:*

HARRY F. MANBECK, JR.

*Attesting Officer*

*Commissioner of Patents and Trademarks*